United States Patent [19]

Yoshida et al.

[11] Patent Number: 4,639,981

[45] Date of Patent: Feb. 3, 1987

[54] SLIDE FASTENER STRINGER HAVING CONTINUOUS THERMO-PLASTIC MOLDED COUPLING ELEMENT STRIP

[75] Inventors: Hiroshi Yoshida; Akira Hasegawa, both of Kurobe, Japan

[73] Assignee: Yoshida Kogyo K. K., Tokyo, Japan

[21] Appl. No.: 755,972

[22] Filed: Jul. 17, 1985

Related U.S. Application Data

[63] Continuation of Ser. No. 472,626, Mar. 7, 1983, abandoned.

[30] Foreign Application Priority Data

Mar. 8, 1982 [JP] Japan ..... 57-3216[U]

[51] Int. Cl.[4] ..... A44B 19/10

[52] U.S. Cl. ..... 24/401; 24/408; 24/413

[58] Field of Search ..... 24/401, 403, 408, 413

[56] References Cited

U.S. PATENT DOCUMENTS

| | | | |
|---|---|---|---|
| 3,255,504 | 6/1966 | Porepp | 24/401 X |
| 3,328,857 | 7/1967 | Burbank . | |
| 4,210,985 | 7/1980 | Scott | 24/408 |
| 4,290,175 | 9/1981 | Moertel | 24/408 |
| 4,331,493 | 5/1982 | Lawrence | 24/408 X |
| 4,418,449 | 12/1983 | Heimberger et al. | 24/401 |
| 4,429,438 | 2/1984 | Takeshima et al. | 24/401 |
| 4,439,898 | 4/1984 | Takeshima et al. | 24/401 |

*Primary Examiner*—Kenneth J. Dorner
*Assistant Examiner*—James R. Brittam
*Attorney, Agent, or Firm*—Hill, Van Santen, Steadman & Simpson

[57] ABSTRACT

A slide fastener stringer having a continuous zigzag-shaped thermoplastic molded coupling element strip. The strip includes a succession of spaced coupling elements, each having a pair of first and second legs extending from a head in a common direction, and a plurality of first and second solid connecting portions alternately disposed at opposite sides of the strip and extending one between each adjacent pair of the coupling elements. Each first connecting portion and each second connecting portion extend between an adjacent pair of the first legs and between an adjacent pair of the second legs, respectively. The connecting portions are thin or more slender than the legs. A pair of connector threads extends transversely of the coupling elements through the full length of the strip and they are embedded in the first and second legs, respectively, of each coupling element, each connector thread being disposed close to and extending along a respective one of such two series of the first and second connecting portions.

2 Claims, 10 Drawing Figures

SLIDE FASTENER STRINGER HAVING CONTINUOUS THERMO-PLASTIC MOLDED COUPLING ELEMENT STRIP

This is a continuation of application Ser. No. 472,626, filed Mar. 7, 1983, abandoned.

BACKGROUND OF THE INVENTION

1. Field of the Invention

The present invention relates to slide fasteners, and more particularly to a slide fastener stringer having a continuous zigzag-shaped thermoplastic molded coupling element strip attached to a stringer tape along a longitudinal edge thereof.

2. Prior Art

Various slide fastener stringers are known in which a continuous zigzag-shaped strip of thermoplastic molded coupling elements is attached to a stringer tape along a longitudinal edge thereof. The successive coupling elements are interconnected by a plurality of thermoplastic molded connecting portions alternately disposed at opposite sides of the strip and extending one between each adjacent pair of the coupling elements. Because of relatively high rigidity of the thermoplastic connecting portions, the prior art stringers are poor in flexibility.

U.S. Pat. No. 3,328,857 discloses a continuous zigzag-shaped thermoplastic molded coupling element strip having thermoplastic connecting portions which are thin or slender in order to produce an increased degree of flexibility. In general, the slender connecting portions have only an insufficient degree of strength and hence tend to be easily broken or otherwise damaged when the stringer and thus the coupling element strip is bent in an edgewise direction during the opening and closing of a slide fastener. In the strip of U.S. Pat. No. 3,328,857, a flexible core thread is embedded in each series of the thermoplastic connecting portions through the full length of the strip, making the latter more flexible, but, on the other hand, causing each connecting portion to be in the form of a tube having a reduced thickness. Because of this small thickness of the tubular connecting portions, sufficient durability of the strip is difficult to achieve.

SUMMARY OF THE INVENTION

According to the present invention, a continuous zigzag-shaped thermoplastic molded coupling element strip comprises a succession of laterally spaced coupling elements, each having a head and a pair of first and second legs extending from the head in a common direction, and a plurality of first and second solid connecting portions alternately disposed at opposite sides of the strip and extending one between each adjacent pair of the coupling elements. Each of the first connecting portions extends between an adjacent pair of the first legs, and each of the second connecting portions extends between an adjacent pair of the second legs. The connecting portions are more slender than the legs. A pair of connector threads extends transversely of the coupling elements through the full length of the strip and are embedded in the first and second legs, respectively, of each coupling element. Each of the connector threads is disposed close to and extends alongside a respective one of such two series of the first and second connecting portion.

It is therefore an object of the invention to provide a slide fastener stringer having a zigzag-shaped thermoplastic molded coupling element strip which has not only adequate flexibility but also good durability, thus enabling smooth and sure coupling-and-uncoupling operation of the slide fastener, at which time a row of molded coupling elements is bent arcuately away from the coupling elements of a companion stringer in conformity with the Y-shaped guide channel of a slider.

Many other advantages, features and additional objects of the invention will become manifest to those versed in the art upon making reference to the detailed description and the accompanying drawings in which several preferred embodiments incorporating the principles of the invention are shown by way of illustrative example.

DETAILED DESCRIPTION OF THE PREFERRED EMBODIMENTS

The term "close" means either in near relation or in contact.

Figure 1:
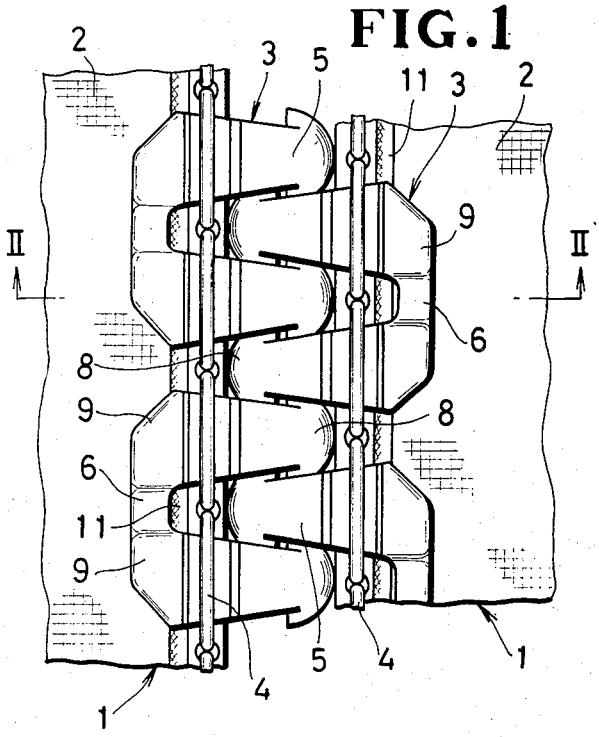
FIG. 1 is a fragmentary plan view of a pair of interengaged slide fastener stringers, each embodying the present invention.
Figure 2:
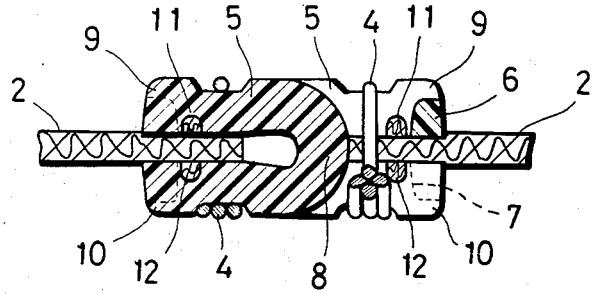
FIG. 2 is a cross-sectional view taken along line II—II of FIG. 1.

FIGS. 1 and 2 illustrate a pair of coupled slide fastener stringers 1,1, each comprising a stringer tape 2 and a continuous zigzag-shaped molded coupling element strip 3 attached to the tape 2 along an inner longitudinal edge thereof by sewn threads 4, the strip 3 being folded on itself along its longitudinal centerline.

Figure 3:
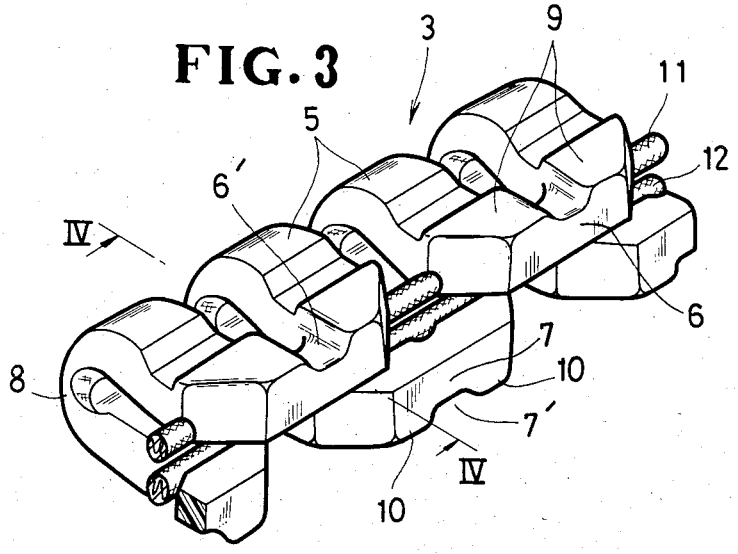
FIG. 3 is a fragmentary perspective view of a continuous molded coupling element strip.
Figure 4:
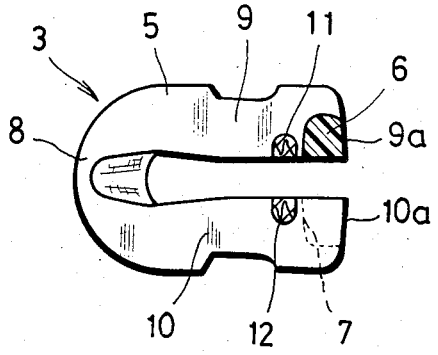
FIG. 4 is a cross-sectional view taken along line IV—IV of FIG. 3.

The coupling element strip 3 is continuously produced on a rotating die wheel (not shown) having an endless zigzag-shaped peripheral cavity receptive of heated thermoplastic synthetic resin, such as polyamid, delivered from a fixed extrusion nozzle (not shown) and, before having been bent into a U-shaped cross section (FIGS. 2, 3 and 4), it has a continuous flat zigzag-shaped structure. The thus folded strip 3 includes a series of substantially parallel spaced coupling elements 5 interconnected by a plurality of first and second solid connecting portions 6,7 alternately disposed at opposite sides of the strip 3 and extending one between each adjacent pair of the coupling elements 5. Each coupling element 5 has a head 8 and a pair of first and second legs 9,10 extending from the head 8 in a common direction and terminating in their respective heels **9*a*,10*a* (FIG. 4). Each first connecting portion 6 extends between an adjacent pair of the first legs 9,9 and is disposed close to the heels 9a,9a thereof, and each second connecting portion 7 extends between an adjacent pair of the second legs 10,10 and is disposed close to the heels 10a,10a** thereof.

As best shown in FIGS. 2 and 4, the first and second connecting portions 6,7 are thinner or more slender than the first and second legs 9,10, and are disposed on the respective inner sides of the first and second legs 9,10 to provide a recess or bay 6',7' (FIG. 3) between each adjacent pair of the coupling elements 5, as viewed in an edgewise direction of the stringer 1.

A pair of first and second connector threads 11,12 extends transversely of the successive coupling elements 5 through the full length of the strip 3 and is embedded in the first and second legs 9,10, respectively, of each coupling element 5. Each of the first and second connector threads, 11,12 is disposed close to and extends alongside a respective one of the two series of the first and second connecting portions 6,7, being disposed close to that side thereof which faces the connecting head. As shown in FIGS. 2, 3 and 4, the first and second connector threads 11,12 are disposed on the respective inner sides of the first and second legs 9,10.

Figure 5:
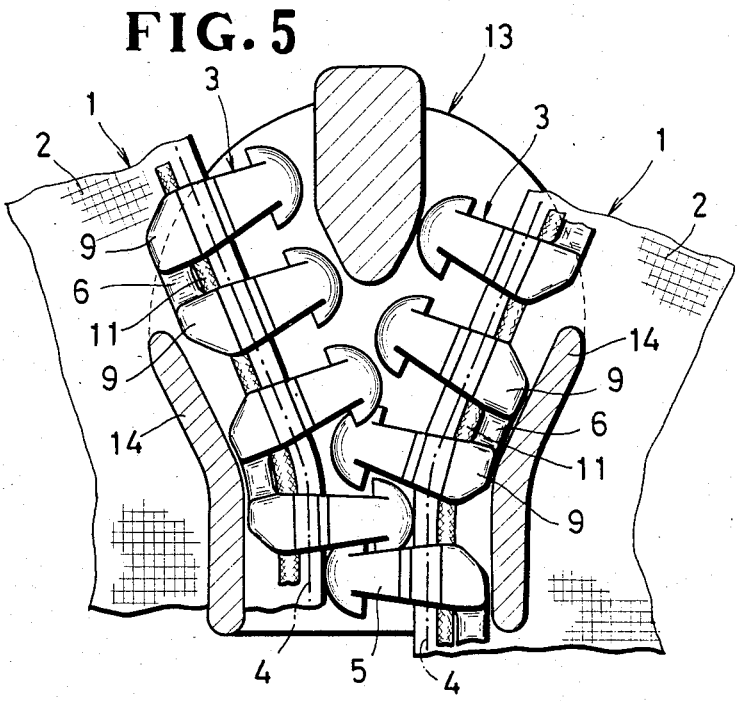
FIG. 5 illustrates the manner in which the opposed coupling element strips are bent in opposite edgewise directions as they are being coupled or uncoupled by a slider.

Partly because the connecting portions 6,7 are more slender than the legs 9,10 and partly because the connector threads 11,12 are disposed close to and extend alongside the respective series of connecting portions 6,7, the coupling element strip 3 has not only adequate flexibility but also good durability; the solid slender connecting portions and the connector threads close thereto coact to produce such advantageous characteristics. This construction enables the coupling element strip 3 to be bent arcuately away from that of a companion stringer in conformity with a respective one of a pair of flaring guide flanges 14,14 of a slider 13 when the opposed stringers 1,1 of a slide fastener are being coupled or uncoupled, as shown in FIG. 5. At that time the connector threads 11,12, which are disposed close to the respective sides of the connecting portions 6,7, which are facing the head, serve to prevent the slender connecting portions from being excessively bent and thus from being broken or otherwise damaged.

Figure 6:
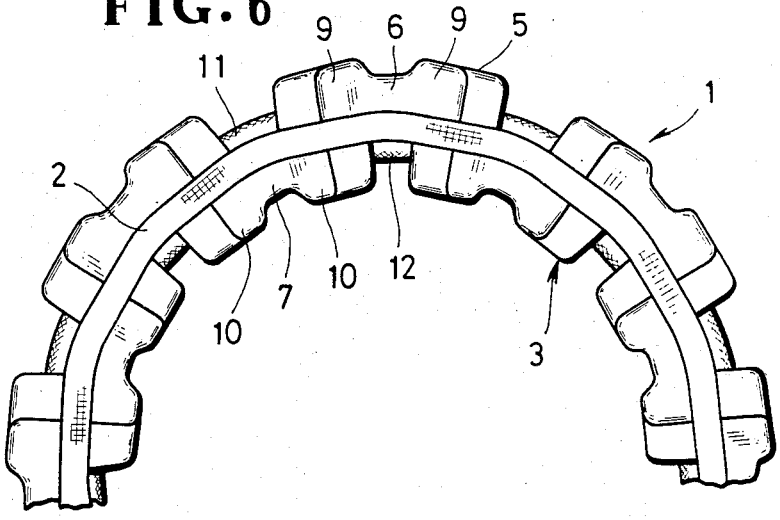
FIG. 6 is a fragmentary side elevational view of the opposed fastener stringers having been bent arcuately in a common facewise direction.

Another advantage of the fastener stringer 1 is that since the first and second slender connecting portions 6,7 are disposed on the respective inner sides of the first and second legs 9,10 to provide the bay 6',7' (FIG. 3) between each adjacent pair of the coupling elements 5, the stringer 1 and thus the coupling element strip 3 can be bent arcuately in a facewise direction, as shown in FIG. 6, without accidental uncoupling of the coupling elements 5 with those of a mating stringer 1. At that time, the first (upper) connecting portions 6 are bent so as to expand the upper bays 6' and, on the contrary, the second (lower) connecting portions 7 are bent so as to shrink the lower bays 7'. At the same time, the inter-coupling-element portions of the first (upper) connector thread 11 are expanded and, on the contrary, the inter-coupling-element portions of the second (lower) connector thread 12 are compressed. Accordingly, the connector threads facilitate expansion of the connecting portions, thus preventing the latter from being broken. The connecting portions in turn protect the connector threads from sudden undue stress, thus preventing the connector threads either from being broken or from being removed from the coupling leg portions.

With this arrangement, smooth and sure coupling-and-uncoupling of the coupling elements 5 is guaranteed for a long time.

Figure 7:
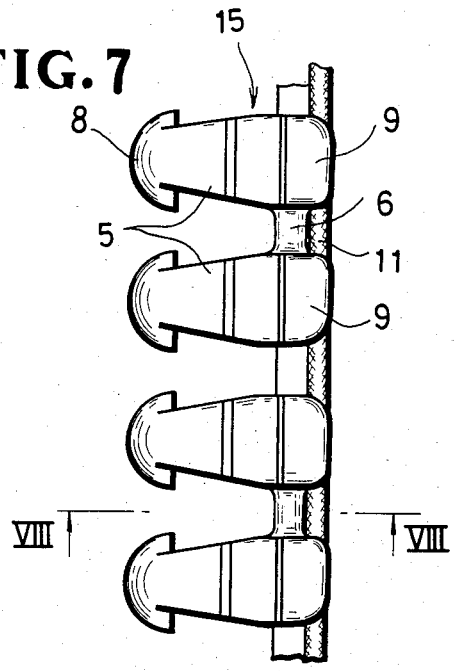
FIG. 7 is a fragmentary plan view of a modified form of molded coupling element strip.
Figure 8:
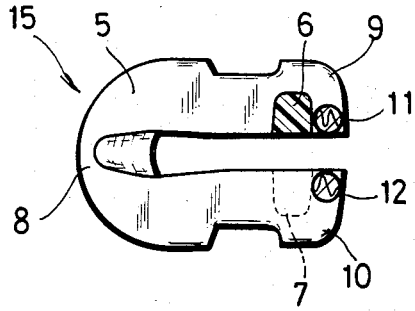
FIG. 8 is a cross-sectional view taken along line VIII—VIII of FIG. 7.

FIGS. 7 and 8 illustrate a modified form of a coupling element strip 15. The modified coupling element strip 15 has the same construction as the strip 3 (FIGS. 1–6) except that the first and second connector threads 11,12 are disposed close to the respective heel sides of the first and second connecting portions 6,7. When the strip 15 is bent arcuately away from the strip of a mating stringer during the closing or opening of a slide fastener, the inter-coupling-element portions of the connector threads 11,12 are compressed and, as a result, they become hard, and thereby prevent the individual connecting portions 6,7 from being excessively bent.

Figure 9:
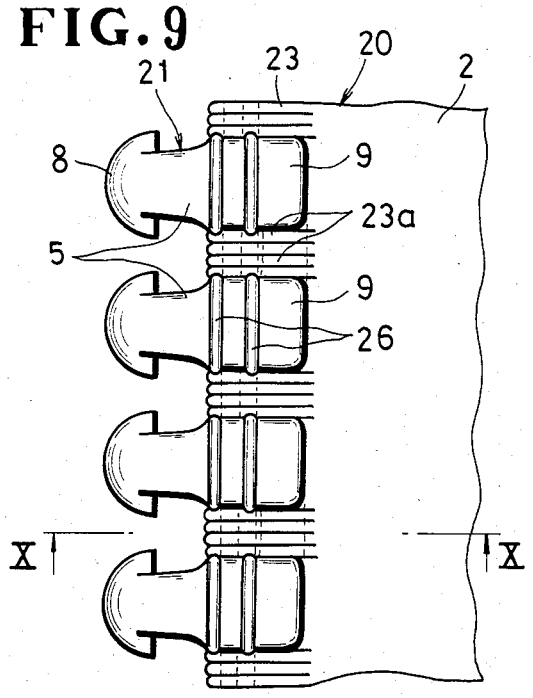
FIG. 9 is a fragmentary plan view of a modified slide fastener stringer.
Figure 10:
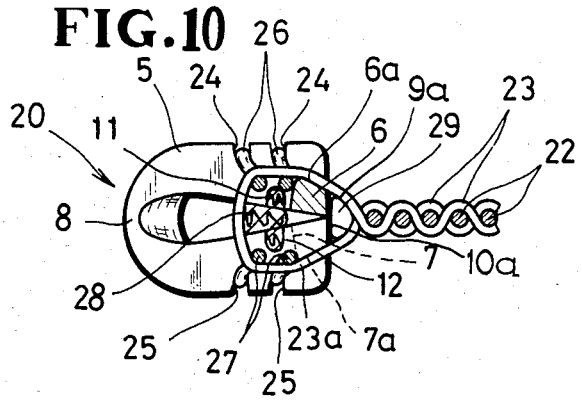
FIG. 10 is a cross-sectional view taken along line X—X of FIG. 9.

FIGS. 9 and 10 illustrate a modified slide fastener stringer 20 in which a modified form of coupling element strip 21 is woven into a woven stringer tape 2 along one longitudinal edge thereof in a known manner, the stringer tape 2 including a plurality of warp threads 22 (FIG. 10) and a weft thread 23. Each coupling element 5 has a pair of parallel first grooves 24,24 extending transversely through the first leg 9 on an outer (upper) side thereof, and a pair of parallel second grooves 25,25 extending transversely through the second leg 10 on an outer (lower) side thereof. As better shown in FIG. 10, a pair of first anchor threads 26,26 and a pair of second anchor threads 27,27 extend through the first grooves 24 and the second grooves 25, respectively, along the full length of the strip 21. A core thread 28 is disposed between the first and second legs 9,10 and extends through the full length of the strip 21. Further, an auxiliary thread 29 is disposed close to the heels 9a,10a and extends through the full length of the strip 21. In the strip 21, each connecting portion 6,7 has an inclined outer surface 6a,7a sloping down to the heel side (rightwardly). The weft thread 23 of the tape 2 has a plurality of loops 23a, each encircling one of the first and second connecting portions 6,7, the anchor threads 26,27, the core thread 28 and the auxiliary thread 29 between adjacent coupling elements 5. Each loop 23a of the weft thread 23 is open widely, perpendicularly to the general plane of the tape 2, urging the first and second anchor threads 26,27 toward one another between adjacent coupling elements 5 to hold the individual coupling elements 5 firmly in position.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A slide fastener stringer comprising:

(a) a stringer tape;

(b) a continuous zigzag-shaped thermoplastic molded coupling element strip attached to said stringer tape by a sewn thread extending along the length of said strip and disposed on and along one longitudinal edge thereof, said strip including (1) a succession of laterally spaced coupling elements, each having a head and a pair of first and second legs extending from said head in a common direction and respectively terminating in a distal end heel, and (2) a plurality of first and second individually spaced solid connecting portions alternately disposed at opposite sides of said strip and extending one between each adjacent pair of said coupling elenents, each of said first connecting portions interconnecting said heels of an adjacent pair of said first legs, each of said second connecting portions interconnecting said heels of an adjacent pair of said second legs, said connecting portions being engageable with a slider and being disposed at the tape-engaging sides of said heels, said connecting portions having a reduced size between said coupling elements remote from said stringer tape to thereby provide flexibility in each connecting portion between said adjacent pair of said coupling elements; and (c) a pair of connector threads extending transversely of said coupling elements through the full length of said strip and embedded only in said first and second legs, respectively, of each said coupling element, each of said connector threads being respectively disposed between said sewn thread and said connecting portions close to and extending along the head side of a respective one of such two series of said first and second connecting portions, each said connector thread being aligned with the respective series of said connecting portions in a plane parallel to the general plane of said stringer tape.

2. A slide fastener stringer comprising:

(a) a woven stringer tape including a plurality of warp threads and a weft thread;

(b) a continuous zigzag-shaped thermoplastic molded coupling element strip woven into said woven stringer tape along one longitudinal edge thereof, said strip including (1) a succession of laterally spaced coupling elements, each having a head and a pair of first and second legs extending from said head in a common direction and respectively terminating in a distal end heel, each said coupling element having a pair of parallel first grooves extending transversely through said first leg on an outer side thereof and a pair of parallel second grooves extending transversely through said second leg on an outer side thereof, (2) a pair of first anchor threads and a pair of second anchor threads extending through said first grooves and said second grooves, respectively, along the full length of said strip, and (3) a plurality of first and second individually sapced solid connecting portions alternately disposed at opposite sides of said strip and extending one between each adjacent pair of said coupling elements, each of said first connecting portions interconnecting said heels of an adjacent pair of said first legs, each of said second connecting portions interconnecting said heels of an adjacent pair of said second legs, said connecting portions being engageable with a slider and being disposed at the tape-engaging sides of said heels, said connecting portions having a reduced size between said coupling elements remote from said stringer tape to thereby provide flexibility in each connecting portion between said adjacent pair of coupling elements;

(c) said weft thread having along said one longitudinal edge of said tape a plurality of loops each encircling said first and second anchor threads and one of said first and second connecting portions between an adjacent pair of said coupling elements; and (d) a pair of connector threads extending transversely of said coupling elements through the full length of said strip and embedded only in said first and second legs, respectively, of each said coupling elements, each of said connector threads being respectively disposed between said connecting portions and one thread from each of said respective pairs of said first and second anchor threads remote from said connecting portions, each said connector threads extending along the head side of a respective one of such two series of said first and second connecting portions and being aligned with the respective series of said connecting portions in a plane parallel to the general plane of said stringer tape.

* * * * *